US005127388A

United States Patent [19]

Cicalese et al.

[11] Patent Number: 5,127,388

[45] Date of Patent: Jul. 7, 1992

[54] IGNITION SYSTEM FOR AN INTERNAL COMBUSTION ENGINE

[75] Inventors: Giuliano Cicalese, Grugliasco; Marco Diaco, Bricherasio; Gianluigi Morello, Turin, all of Italy

[73] Assignee: Marelli Autronica SPA, Milan, Italy

[21] Appl. No.: 671,332

[22] Filed: Mar. 19, 1991

[30] Foreign Application Priority Data

Mar. 19, 1990 [IT] Italy ..... 67199 A/90

[51] Int. Cl.[5] ..... F02P 3/055

[52] U.S. Cl. ..... 123/644; 123/652

[58] Field of Search ..... 123/644, 652, 618

[56] References Cited

U.S. PATENT DOCUMENTS

| | | | |
|---|---|---|---|
| 3,938,490 | 2/1976 | Snyder | 123/644 |
| 4,375,794 | 3/1983 | Wasmer | 123/652 |
| 4,617,905 | 10/1986 | Hill | 123/644 |
| 4,774,925 | 10/1988 | Iwata | 123/644 |
| 4,776,311 | 10/1988 | Venieres | 123/644 |
| 4,918,569 | 4/1990 | Maeda | 123/652 |
| 5,018,493 | 5/1991 | Minks | 123/618 |
| 5,056,497 | 10/1991 | Akagi | 123/644 |
| 5,058,560 | 10/1991 | Asakura | 123/652 |

*Primary Examiner*—Carl Stuart Miller

*Attorney, Agent, or Firm*—Sughrue, Mion, Zinn, Macpeak & Seas

[57] ABSTRACT

The system comprises: at least one spark plug, at least one ignition coil whose secondary winding is connected to the plug, a power transistor whose output path is in series with the primary winding of the coil between the two terminals of a direct-current voltage supply, and a control circuit for switching the transistor from the cut-off condition to the saturated condition to enable current to flow in the primary winding of the coil in order to generate a spark. Conveniently, the control circuit is arranged to switch the transistor progressively from the cut-off condition to the saturated condition, in dependence on the voltage detected between the terminals of its output path by the application of a driver signal which is first continuous and then pulsed.

5 Claims, 2 Drawing Sheets

IGNITION SYSTEM FOR AN INTERNAL COMBUSTION ENGINE

DESCRIPTION

Figure 1:
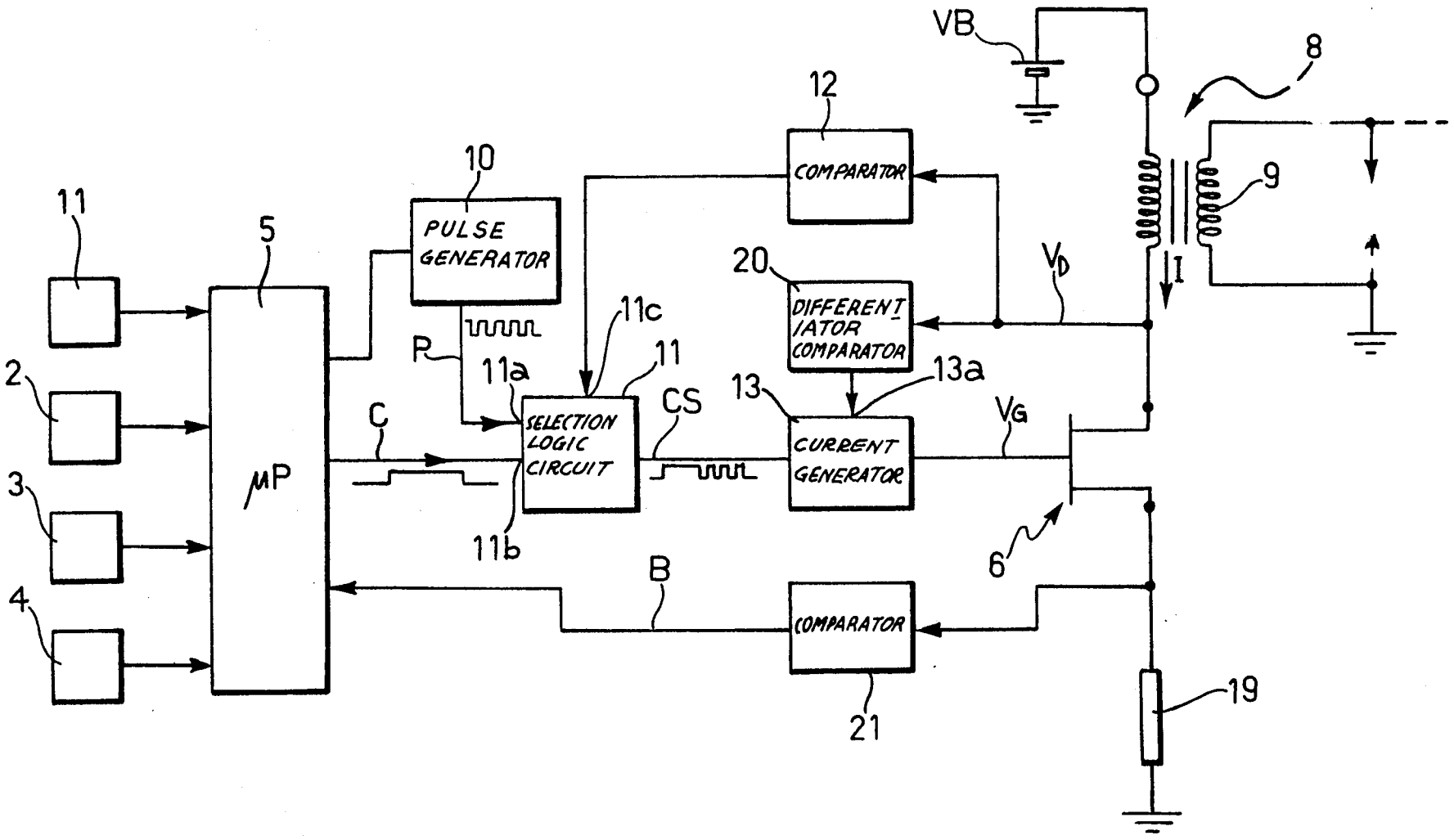

The present invention relates to an ignition system for an internal combustion engine.

More specifically, the subject of the invention is an ignition system comprising:

at least one spark plug, at least one ignition coil whose secondary winding is connected or connectible to the at least one plug, a power transistor whose output path is in series with the primary winding of the coil between the two terminals of a direct-current voltage supply, a driver circuit for the transistor, means for detecting the potential difference between the terminals of the output path of the transistor, and control circuit means connected to the driver circuit for switching the transistor gradually from the cut-off condition to the saturated condition in a controlled manner in dependence on the potential difference in order to cause current to flow in the primary winding of the coil, the control means including electronic processing means for generating a logic control signal in which, to generate a spark, there is a first change of level to start the switching of the transistor to the saturated condition and the flow of current in the primary winding of the coil, and a second change of level to cut off the transistor and trigger the spark.

An ignition system of this type is described in the same Applicant's prior Italian patent application No. 67962-A/89.

In ignition systems of this type, in order to generate a spark in a plug, the power transistor associated with the plug is switched gradually from the cut-off condition to the saturated conditon in a controlled manner in dependence on the voltage detected between its collector and its emitter, that is, between its drain and its source, in order to prevent overvoltages in the secondary winding of the associated ignition coil. In effect, a sudden and uncontrolled switching of the transistor from the cut-off condition to the saturated condition would cause a voltage peak to appear in the secondary winding of the ignition coil, followed by a damped oscillation attributable to the intrinsic stray capacitance of the system. This peak might trigger a spurious, that is, an undesired, spark and, in order to avoid this, a diode suitable for high voltages, which is quite expensive, is usually put in series with the plug.

The object of the present invention is to provide an ignition system of the type specified at the beginning which enables a more precise and effective progressive control of the switching of the transistor between the cut-off and saturated conditions.

According to the invention, this object is achieved by means of a system of the type specified above, characterised in that the control circuit means also include:

a pulse generator for generating pulses at a frequency greater than the reciprocal of the minimum time interval between the first and second changes in the control logic signal, a comparator for supplying a control signal when the potential difference between the terminals of the output path of the transistor falls to a predetermined threshold value during the switch from the cut-off condition to the saturated condition, and a selection logic circuit having first and second inputs connected to the processing means and to the pulse generator respectively, a control input connected to the input of the comparator, and an output connected to the driver circuit for the transistor, the selection logic circuit being arranged to transmit to the driver circuit:

a) the logic control signal generated by the processing means as long as the potential difference between the terminals of the output path of the transistor is above the threshold value, and b) the pulses emitted by the generator when the comparator circuit emits its control signal.

Figure 2:
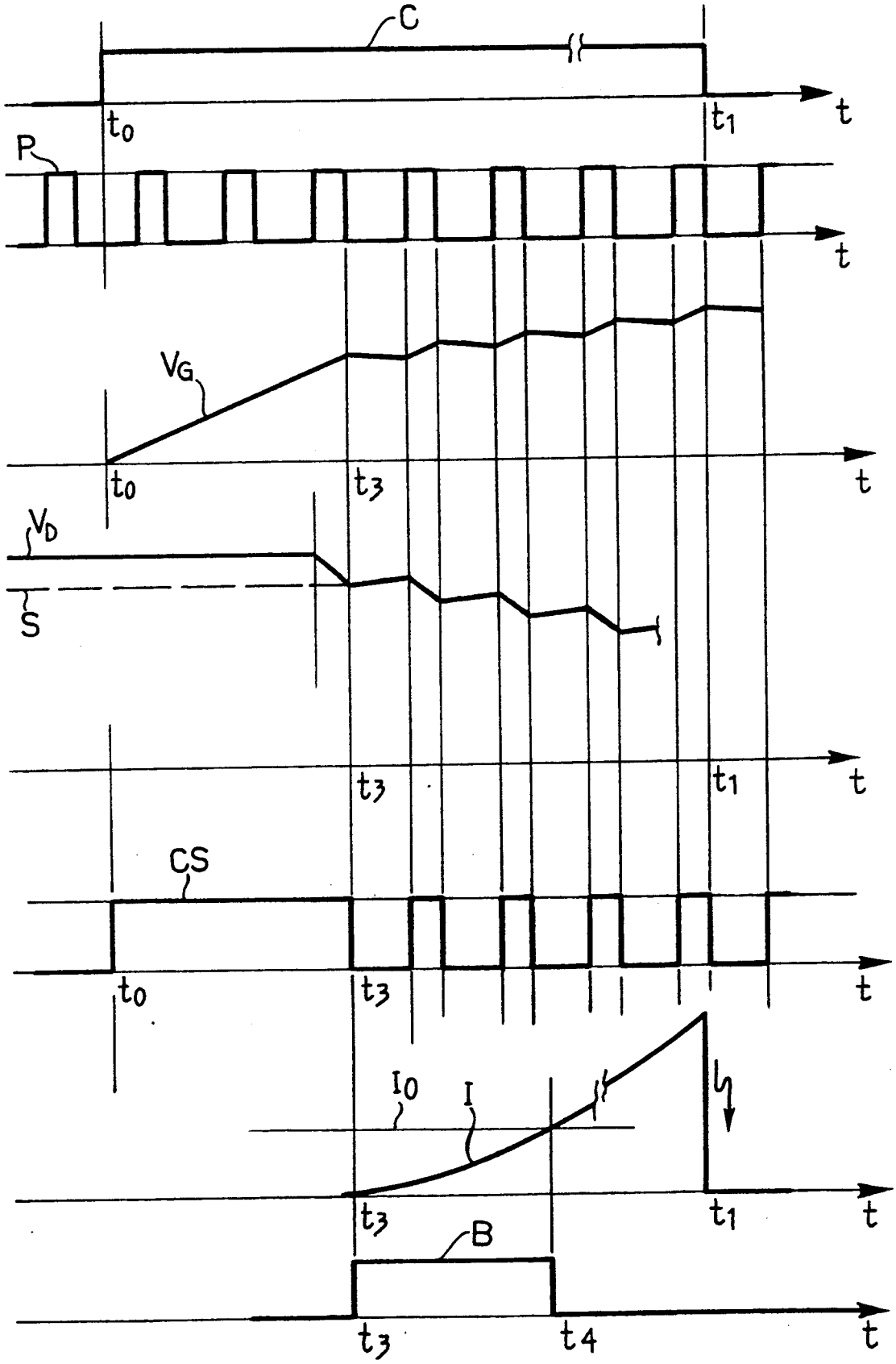

Further characteristics and the advantages of the present invention will become clear from the detailed description which follows with reference to the appended drawings, provided purely by way of non-limiting example, in which:

FIG. 1 is a partial block diagram showing an ignition system according to the present invention, and FIG. 2 shows graphs of some signals generated in the system of FIG. 1 in operation, as functions of time.

The ignition system shown in FIG. 1 includes a sensor 1 for outputting a signal whose frequency is indicative of the rate of rotation of the shaft of the internal combustion engine. From the signal supplied by that sensor, which may comprise, for example, a toothed wheel associated with a magnetic pick-up, it is also possible — in known manner — to derive data on the angular position of the engine shaft and to determine the moments at which the spark must be struck in the various cylinders.

Further sensors, indicated 2 to 4, output electrical signals indicative of the vacuum in the intake manifold of the engine, the intake-air temperature, and the temperature of the engine cooling water.

The sensors 1 to 4 are connected to a electronic control unit 5 with a miroprocessor of known type with memory devices.

The drain-source path of a MOSFET power transistor, indicated 6, is connected in series with the primary winding 7 of an ignition coil 8 between the terminals of a direct-current voltage supply $V_B$ (the motor vehicle's battery). The coil 8 includes a secondary winding 9 connected to a spark plug SP.

The output of a pulse generator 10 is connected to a first input 11*a* of a selection logic circuit 11 which has a second input 11*b* connected to an output of the electronic control unit 5. The selection circuit has a control input 11*c* connected to the output of a comparator 12. This comparator has an input connected to the drain of the transistor 6.

The logic selection circuit 11 is arranged selectively to transmit from its output the signal coming from the electronic unit 5 or that coming from the pulse generator 10, according to the signal applied to its control input 11*c*.

The output of the selection logic circuit 11 is connected to the control input of a current generator 13 whose output is connected to the gate of the transistor 6.

In the embodiment illustrated, the current generator 13 applies a current signal of constant intensity to the gate of the transistor 6 when the signal supplied to it by the selection logic circuit is at a "high" level, whilst it does not generate a current when that signal is at a "low" level.

In operation, electronic control unit 5 is arranged, in known manner, to calculate the ignition advance on the basis of the signals provided by the sensors 1 to 4. In order to generate a spark in the plug SP, the unit 5 is particularly arranged, also in known manner, to output a logic control signal, indicated C in FIGS. 1 and 2. In the embodiment illustrated, the signal C first changes from the "low" level to the "high" level at an instant $t_0$ and then stays at the high level until a subsequent instant $t_1$ when the spark is to be produced. The time interval between the two changes in the level of the signal C varies according to the rate of rotation of the engine.

The pulse generator 10 is arranged to generate pulses at a frequency greater than the reciprocal of the minimum time interval between the aforesaid two changes in the control logic signal emitted by the control unit 5.

In operation, when the unit 5 emits the signal C, the transistor 6 is cut off and the comparator 12 keeps the selection logic circuit 11 in the condition in which it transfers the signal from the unit 5 to the input of the current generator. At this stage, the drain potential $V_D$ of the transistor 6 is kept at a high level substantially equal to the voltage $V_B$ of the supply minus the small voltage drop across the primary winding 7 of the ignition coil 8.

As soon as the potential of the gate of the transistor 6 reaches a level such as to make the transistor conductive at an instant $t_2$, its drain potential $V_D$ falls quite quickly and, at an instant $t_3$, crosses the threshold s (FIG. 2) associated with the comparator 12. Conveniently, this threshold is quite near to the maximum (instantaneous) voltage assumed by $V_D$ and its value may conveniently be variable with variations in the battery voltage $V_B$. At the instant $t_3$, the comparator 12 acts on the selection logic circuit 11, which, in practice, is a kind of multiplexer, and, from that instant, the latter transfers the pulsed signal P supplied by the generator 10 to the current generator 13. Overall, therefore, the signal output by the selection logic circuit 11 behaves as indicated by the curve CS in FIG. 2.

From the instant $t_3$, the current generator is activated in correspondence with each pulse of the signal P to cause a gradual stepped increase in the gate potential $V_G$ of the transistor 6. The drain potential $V_D$ of the transistor is reduced very gradually in steps in a corresponding manner, as shown in FIG. 2. This gradual variation of $V_D$ effectively prevents overvoltages in the secondary winding of the ignition coil 8 and thus prevents the triggering of spurious sparks.

From the instant $t_3$, a current having the curve I shown by way of example in FIG. 2 gradually starts to flow in the primary winding 7 of the ignition coil 8. This current reaches its maximum intensity at the instant $t_1$ when it is switched off abruptly to produce the spark.

Now, if one looks at the curve of the signal CS applied by the selection circuit 11 to the input of the current generator 13, it can be seen that this signal has the advantage that it is continuous during the initial stage of the switching of the transistor 6. This enables the transistor to be brought quickly to the threshold at which it switches from the cut-off condition to the conducting condition. The speed at which this stage is reached is very important in view of the fact that the time usable to bring the current in the primary winding of the ignition coil to a level sufficient to ensure the striking of the spark is extremely short, particularly at high rates of revolution of the internal combustion engine.

The reduction of $V_D$ can be controlled more precisely the pulse generator 10 is of the type whose frequency or duty cycle can be varied in dependence on the time period $(t_3-t_0)$ which can be "monitored" by the unit 5 and/or on the time period $(t_4-t_3)$. The variability of the frequency or the duty cycle in dependence on the time period $(t_3-t_0)$ counteracts the effects of the spread (inequality, inconsistency) of the characteristics of the power transistors used. The variability of the frequency or the duty cycle in dependence on $(t_4-t_3)$ counteracts the spread of the characteristics of the ignition coils and, in particular, of their primary windings.

In order further to improve the manner in which the variation of $V_D$ between the cut-off condition and the saturated condition of the transistor 6 is controlled, the current generator 13 may be formed so as to output a current of constant intensity which can be varied in dependence on a control signal applied to an input indicated 13*a* in FIG. 1. In this case, that input of the current generator is conveniently connected to the output of a circuit 20 for monitoring and analysing $V_D$, which is arranged to reduce the intensity of the current emitted by the generator 13 when the rate of decrease of $V_D$ exceeds a predetermined value and/or when a decremental step of $V_D$ is greater than a preset value. The circuit 20 can be formed in a manner obvious to an expert in the art, for example, with the use of differentiating and comparison circuits.

Finally, a sensing resistor 19 may be provided between the source of the transistor 6 and earth, the voltage developed between its terminals in operation being proportional to the intensity of the current I. In this case, the resistor is conveniently connected to the input of a threshold comparator 21 which compares the voltage across the resistor with predetermined reference values and supplies the electronic control unit 5 with a signal having, for example, the curve indicated B in FIG. 2, with a change in level at the instant $t_4$ when the current I exceeds a predetermined threshold $I_0$. The control unit 5 can then generate its own control signals C on the basis of the time taken for the current I to reach the value $I_0$ so as to ensure that an adequate current level is reached in the primary winding 7 to enable the spark to be struck even if the voltage $V_B$ is below its nominal value.

Naturally, the principle of the invention remaining the same, the forms of embodiment and details of construction may be varied widely with respect to those described and illustrated purely by way of non-limiting example, without thereby departing from the scope of the present invention.

Thus, in general, the power transistor could be an IGBT (insulated gate bipolar transistor) instead of a MOSFET.

We claim:

1. An ignition system for an internal combustion engine, comprising:

at least one spark plug, at least one ignition coil whose secondary winding is connected or connectible to the at least one plug, a power transistor whose output path is in series with the primary winding of the coil between the two terminals of a direct-current voltage supply, a driver circuit for the transistor, means for detecting the potential difference between the output terminals (drain, source) of the transistor, and control circuit means connected to the driver circuit for switching the transistor gradually from the cut-off condition to the saturated condition in a controlled manner in dependence on the potential difference in order to cause current to flow in the primary winding of the coil, the control means including electronic processing means for generating a logic control signal in which, to generate a spark, there is a first change of level to start the switching of the transistor to the saturated condition and the flow of current in the primary winding of the coil, and a second change of level to cut off the transistor and trigger the spark;

the control circuit means also including:

a pulse generator for generating pulses at a frequency greater than the reciprocal of the minimum time interval between the first and second changes in the control logic signal, a comparator for supplying a control signal when the potential difference between the output terminals of the transistor falls to a predetermined threshold value during the switch from the cut-off condition to the saturated condition, and a selection logic circuit having first and second inputs connected to the processing means and to the pulse generator respectively, a control input connected to the input of the comparator, and an output connected to the driver circuit for the transistor, the selection logic circuit being arranged to transmit to the driver circuit:

a) the logic control signal generated by the processing means as long as the potential difference between the output terminals of the transistor is above the threshold value, and b) the pulses emitted by the generator when the comparator circuit emits its control signal.

2. An ignition system according to claim 1, wherein the pulse generator is adapted to generate pulses whose frequency or duty cycle is variable in dependence on the time period between the first change in the control logic signal and the instant when the potential difference between the output terminal (drain-source) of the transistor is reduced to a predetermined value or by a predetermined extent and/or in dependence on the time period in which the current in the primary winding of the ignition coil reaches a predetermined value.

3. An ignition system according to claim 1, wherein the power transistor is a MOSFET or an IGBT transistor and the associated driver circuit comprises a current generator.

4. An ignition system according to claim 3, wherein the current generator is adapted to generate a constant current of variable intensity, and wherein the control circuit means include a circuit which analyses the potential difference between the output terminals of the transistor and is arranged to apply to the current generator a signal for varying the intensity of the current generated in a predetermined manner in dependence on the variation of the potential difference.

5. An ignition system according to claim 4, wherein the analysis circuit comprises differentiation and comparison circuits.

* * * * *